United States Patent [19]

Nakajo et al.

[11] Patent Number: 4,468,919

[45] Date of Patent: Sep. 4, 1984

[54] METHOD OF AND APPARATUS FOR JOINING END PORTIONS OF MULTIFILAMENT YARNS

[75] Inventors: Jiro Nakajo; Shunzo Naito, both of Matsuyama, Japan

[73] Assignee: Teijin Seiki Company Limited, Osaka, Japan

[21] Appl. No.: 524,315

[22] Filed: Aug. 18, 1983

[51] Int. Cl.[3] ..... D01H 15/00

[52] U.S. Cl. ..... 57/22

[58] Field of Search ..... 57/22

[56] References Cited

U.S. PATENT DOCUMENTS

| | | | |
|---|---|---|---|
| 3,273,330 | 9/1966 | Gonsalves | 57/22 X |
| 3,903,680 | 9/1975 | Isern | 57/22 |
| 4,170,103 | 10/1979 | Norris et al. | 57/22 X |
| 4,217,749 | 8/1980 | Rohner et al. | 57/22 X |
| 4,406,115 | 9/1983 | Negaty-Hindi et al. | 57/22 |

*Primary Examiner*—Donald Watkins

*Attorney, Agent, or Firm*—Cushman, Darby & Cushman

[57] ABSTRACT

Respective leading and trailing end portions of two multi-filament yarns are joined together by disposing the leading and trailing end portions of the two multi-filament yarns in longitudinally contacting conditions, clamping the end portions of the multi-filament yarns at two points which are located at a predetermined distance from each other, drawing and slackening the end portions of the yarns between the two points, and blowing air under pressure toward the end portions of the yarns so that a jet stream of air impinges at a predetermined angle upon the end portions of the yarns over a predetermined length of the end portions between the two points for causing the end portions of the yarns to disintegrate into filaments over the aforesaid predetermined length and causing the filaments to entwine on one another.

19 Claims, 3 Drawing Figures

METHOD OF AND APPARATUS FOR JOINING END PORTIONS OF MULTIFILAMENT YARNS

FIELD OF THE INVENTION

The present invention relates to a method of and an apparatus for joining together end portions of two multi-filament yarns.

GENERAL BACKGROUND OF THE INVENTION

In the field of textile production, particularly of the production of synthetic textile yarns, it has been an ordinary practice to have leading and trailing end portions of two multi-filament yarns spliced together by forming a tight knot such as a fisherman's knot either manually or by the use of mechanical knotting or splicing means. The knot thus formed between the leading and trailing end portions of the yarns is a few times larger in diameter than each of the yarns. When the yarn consisting of the multi-filament yarns tied together in this fashion is twisted with use of a friction-disc false twister, the knot of the yarn tends to hitch to the friction disc and may cause the yarn to break in the neighborhood of the knot or fail to untwist partially. The present invention contemplates solution of such a problem which has been encountered in splicing multi-filament yarns together.

It is therefore an important object of the present invention to provide a novel method of joining or interweaving two multi-filament yarns together without forming a large-diameter knot in the conjoined or interwoven portions of the yarns.

Another important object of the present invention is to provide a yarn-end joining apparatus adapted to put the method into practice in the field of textile production.

SUMMARY OF THE INVENTION

In accordance with one outstanding aspect of the present invention, there is provided a method of joining together respective leading and trailing end portions of two multi-filament yarns, comprising the steps of disposing the leading and trailing end portions of the two multi-filament yarns in longitudinally contacting conditions, clamping the end portions of the multi-filament yarns at two points which are located at a predetermined distance from each other, drawing and slackening the end portions of the yarns between the two points, and blowing air under pressure toward the end portions of the yarns so that a jet stream of air impinges at a predetermined angle upon the end portions of the yarns over a predetermined length of the end portions between the two points for causing the end portions of the yarns to disintegrate into filaments over the aforesaid predetermined length and causing the filaments to entwine on one another.

In accordance with another outstanding aspect of the present invention, there is provided a yarn-end joining apparatus for joining together respective leading and trailing end portions of two multi-filament yarns, comprising first and second clamp means operable for clamping the end portions of the multi-filament yarns at two points which are located at a predetermined distance from each other, first and second yarn drawing and slackening means operable for drawing and slackening, between the first and second clamp means, the end portions of the yarns having the end portions clamped by the first and second clamp means, at least one of the first and second yarn drawing means being movable toward and away from the other yarn drawing means, and air blowing means positioned between the first and second clamp means and operable for blowing air under pressure toward the end portions of the yarns so that a jet stream of air impinges at a predetermined angle upon the end portions of the yarns over a predetermined length of the end portions between the first and second clamp means for causing the end portions of the yarns to disintegrate into filaments over the aforesaid predetermined length and causing the filaments to entwine on one another.

BRIEF DESCRIPTION OF THE DRAWINGS

The features and advantages of a method and an apparatus according to the present invention will be more clearly appreciated from the following description taken in conjunction with the accompanying drawings in which.

DESCRIPTION OF THE PREFERRED EMBODIMENTS

Figure 1:
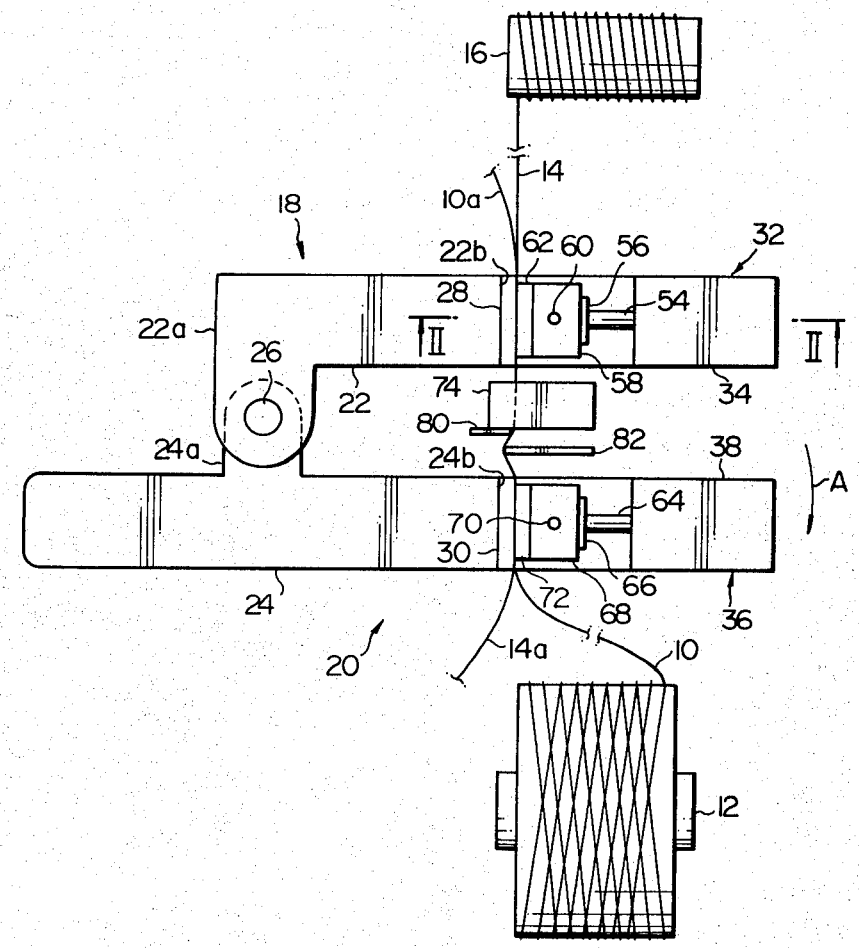
FIG. 1 is a schematic plan view showing a preferred embodiment of a yarn-end joining apparatus according to the present invention.

Referring to FIG. 1 of the drawings, a yarn-end joining apparatus embodying the present invention is used for splicing together two undrawn or partially drawn multi-filament yarns consisting of a first multi-filament yarn 10 leading from a first yarn package such as a cheese on a supply bobbin 12 and a second multi-filament yarn 14 leading to a second yarn package such as a cheese on a take-up bobbin 16. Thus, the first multi-filament yarn 10 has a leading end portion 10*a* and the second multi-filament yarn 14 has a trailing end portion 14*a*. The yarn-end joining apparatus embodying the present invention is provided between the bobbins 12 and 16 and are arranged in such a manner that the respective leading and trailing end portions 10*a* and 14*a* of the first and second multi-filament yarns 10 and 14 are longitudinally held in contact with each other and are transversely passed through the apparatus.

The yarn-end joining apparatus shown in FIG. 1 comprises first and second drawing and slackening units 18 and 20 which are positioned between the supply bobbin 10 and the take-up bobbin 16 and which are elongated in directions transverse to the direction in which the leading and trailing end portions 10*a* and 14*a* of the yarns 10 and 14 are to extend between the bobbins 12 and 16. The first drawing and slackening unit 18 is shown positioned closer to the take-up bobbin 16 than the second drawing and slackening unit 20 and comprises a stationary clamp holder 22 having a lug portion 22*a* which is perpendicularly bent toward the second drawing and slackening unit 20. The second drawing and slackening unit 20 also has a rockable clamp holder 24 having a lug portion 24*a* overlapping the lug portion 22*a* of the clamp holder 22 of the first drawing and slackening unit 18 and coupled to the lug portion 22*a* by means of a pivot pin 26. The pivot pin 26 has a center axis which is perpendicular in non-intersecting relationship to the direction in which the first drawing and slackening unit 18 as a whole is elongated. The second drawing and slackening unit 20 as a whole is thus rockable about the center axis of the pivot pin 26 with respect to the first drawing and slackening unit 18. Though not shown in the drawings, the rockable clamp holder 24 of the second drawing and slackening unit 20 is operatively connected to or engaged by suitable drive means adapted to drive the clamp holder 24 to turn about the center axis of the pivot pin 26 between a first predetermined position extending in parallel with the stationary clamp holder 22 of the first drawing and slackening unit 18 as shown and a predetermined second angular position angularly spaced wider apart from the clamp holder 22. The clamp holders 22 and 24, the pivot pin 26 and the drive means for the rockable clamp holder 24 constitute in combination yarn drawing means in the embodiment herein shown. The stationary clamp holder 22 of the first drawing and slackening unit 18 has an end face 22*b* which is located adjacent the path of the leading and trailing end portions 10*a* and 14*a* of the yarns 10 and 14 between the bobbins 12 and 16 and which is parallel with the center axis of the pivot pin 26. Likewise, the clamp holder 24 of the second drawing and slackening unit 20 has an end face 24*b* adjacent the path of the leading and trailing end portions 10*a* and 14*a* of the yarns 10 and 14 between the bobbins 12 and 16 and parallel with the center axis of the pivot pin 26. As will be seen more clearly from FIG. 2 of the drawings, a preferably elastic, stationary clamp element 28 is securely attached to the end face 22*b* of the clamp holder 22 and, similarly, a preferably elastic, stationary clamp element 30 is securely attached to the end face 24*b* of the clamp holder 24. The clamp elements 28 and 30 have outer faces on a common plane perpendicular to the direction of elongation of the first drawing and slackening unit 18 and are to have the leading and trailing end portions 10*a* and 14*a* of the yarns 10 and 14 received on these faces during operation of the apparatus as will be understood more clearly as the description proceeds. Thus, the respective outer faces of the stationary clamp elements 28 and 30 of the first and second drawing and slackening units 18 and 20 define a predetermined path along which the leading and trailing end portions 10*a* and 14*a* of the yarns 10 and 14 longitudinally extend between the first and second drawing and slackening units 18 and 20. The predetermined path of the leading and trailing end portions 10*a* and 14*a* is preferably perpendicular, either in intersecting or non-intersecting relationship, to the respective axes of rotation of the bobbins 12 and 16 as shown.

Figure 2:
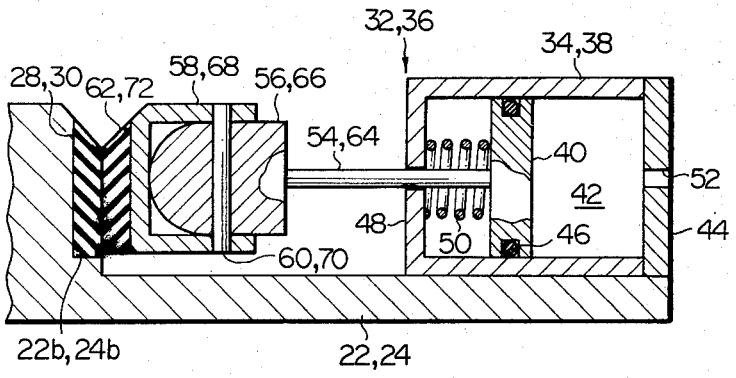
FIG. 2 is a longitudinal sectional view showing, to an enlarged scale, clamp means forming part of the yarn-end joining apparatus shown in FIG. 1, the section being taken on along line II—II in FIG. 1.

The first drawing and slackening unit 18 further comprises a fluid-operated, single-action power cylinder 32 having a hollow cylinder body 34 fixedly mounted on an extension of the clamp holder 22 from the end face 22*b* thereof. Likewise, the second drawing and slackening unit 20 further comprises a fluid-operated, single-action power cylinder 36 having a hollow cylinder body 38 fixedly mounted on an extension of the clamp holder 24 from the end face 24*b* thereof. The arrangements of the power cylinders 32 and 36 of the first and second drawing and slackening units 18 and 20 are similar to each other and are for this reason commonly illustrated to an enlarged scale in FIG. 2. As shown in FIG. 2, the cylinder body of each of the power cylinders 32 and 36 has provided therein a piston 40 which is axially slidable on the inner peripheral surface of the cylinder body and which has a variable-volume fluid chamber 42 defined between the piston 40 and one end wall 44 of the cylinder body. The piston 40 has a circumferential groove in its outer peripheral wall and has an annular seal element 46 received in the groove, sealing the fluid chamber 42 from the variable-volume chamber defined between the piston 40 and the other end wall 48 of the cylinder body. In this variable-volume chamber is provided a preloaded helical compression spring 50 which is seated at one end on the piston 40 and at the other on the inner face of the end wall 48 of the cylinder body, urging the piston 40 to move in a direction to contract the variable-volume fluid chamber 42. The opposite end wall 44 of the cylinder body is formed with an aperture 52 providing communication between the fluid chamber 42 and a suitable source of fluid under pressure through a valved fluid passageway, though not shown in the drawings. The piston 40 is thus forced to move against the opposing force of the compression spring 50 in a direction to expand the fluid chamber 42 in the presence of a fluid pressure developed in the fluid chamber 42 through the aperture.

Referring concurrently to FIGS. 1 and 2, the power cylinder 32 of the first drawing and slackening unit 18 further comprises a piston rod 54 extending from the piston 40. The piston rod 54 axially extends outwardly from the end wall 48 of the cylinder body 34 toward the stationary clamp element 28 on the clamp holder 22 through an aperture formed in the end wall 48. The piston rod 54 has fixedly carried at the leading end thereof a head member 56 which is partly received in a hollow receptacle 58 and which is securely coupled to the receptacle 58 by means of, for example, a pin 60, as will be better seen from FIG. 2. The receptacle 58 has securely attached to the foremost end face a preferably elastic, movable clamp element 62 which is located in alignment with the stationary clamp element 28 on the end face 22*b* of the clamp holder 22. The clamp element 62 carried on the receptacle 58 is thus movable into and out of a position contacting the stationary clamp element 28 on the clamp holder 22 as shown in FIG. 2 as the piston 40 of the power cylinder 32 is moved respectively in directions to expand and contract the fluid chamber 42 in the cylinder body 34.

Likewise, the power cylinder 36 of the second clamping and drawing unit 20 further comprises a piston rod 64 extending from the piston 40. The piston rod 64 axially extends outwardly from the end wall 48 of the cylinder body 38 toward the stationary clamp element 30 on the clamp holder 24 through an aperture formed in the end wall 48. The piston rod 64 has fixedly carried at the leading end thereof a head member 66 partly received in a receptacle 68 and which is securely coupled to the receptacle 68 by means of a pin 70. The receptacle 68 has securely attached to the foremost end face a preferably elastic movable clamp element 72 which is located in alignment with the stationary clamp element 30 on the end face 24*b* of the clamp holder 24. The clamp element 72 is thus also movable into and out of a position contacting the stationary clamp element 30 on the clamp holder 24 as the piston 40 of the power cylinder 36 is moved respectively in directions to expand and contract the fluid chamber 42 in the cylinder body 38. Each of the above mentioned contact elements 28, 30, 62 and 72 is preferably constructed of an appropriate non-metallic elastic material such as, for example, polyurethane rubber. If it is desired to have these clamp elements constructed of metal, such clamp elements may be mirror finished to have smooth contact surfaces. The power cylinders 32 and 36, the head members 56 and 66, the receptacles 58 and 68 and the clamp elements 28, 30, 62 and 72 as above described constitute yarn drawing means in the embodiment herein shown.

Figure 3:
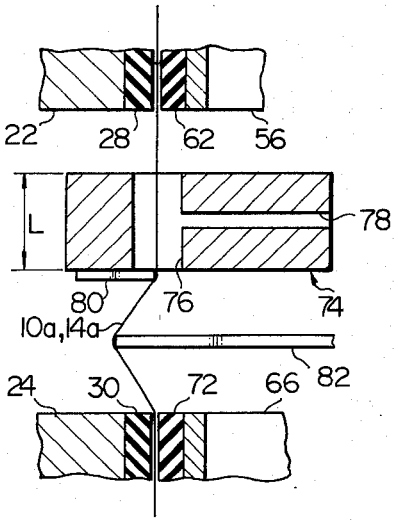
FIG. 3 is a sectional view showing, also to an enlarged scale, the arrangement including air blowing means forming part of the apparatus embodying the present invention.

The yarn-end joining apparatus embodying the present invention further comprises filament intertwining means or air blowing means which is constituted by a stationary air injection block 74 which is fixedly positioned between the first and second drawing and slackening units 18 and 20 as illustrated to an enlarged scale in FIG. 3 of the drawings. As shown in FIG. 3, the air injection block 74 is formed with a straight yarn passageway 76 aligned with the previously mentioned predetermined path of the leading and trailing end portions 10*a* and 14*a* of the yarns 10 and 16, and a preferably straight air injection passageway 78 perpendicularly open at one end to the yarn passageway 76. The yarn passageway 76 has an inlet end which is open toward the second drawing and slackening unit 20 and an outlet end which is open toward the first drawing and slackening unit 18. Though not shown in the drawings, the air injection passageway 78 communicates at the other end thereof with a suitable source of air under pressure such as an air compressor through a valved air passageway. When the valve intervening between the air injection block 74 and the air compressor is made open, compressed air is thus injected perpendicularly into the yarn passageway 76 through the air injection passageway 78. The length, denoted by L, of the yarn passageway 76 is preferably within the range of between about 4 mm and about 12 mm for the reasons to be clarified later. If desired, a guide member 80 may be attached to the end face of the air injection block 74 in the vicinity of the inlet end of the yarn passageway 76 so as to guide the leading and trailing end portions 10*a* and 14*a* of the yarns 10 and 14 to extend correctly along the predetermined path thereof between the drawing and slackening units 18 and 20 (FIG. 1).

Between the above described air injection block 74 and the second drawing and slackening unit 20 is provided a tension adjusting member 82 which is movable at right angles to the predetermined path of the leading and trailing end portions 10*a* and 14*a* of the yarns 10 and 14. The tension adjusting member 82 is engageable with the leading and trailing end portions 10*a* and 14*a* of the yarns 10 and 14 between the air injection block 74 and the second clamping and drawing unit 20 and is adapted to force the leading and trailing end portions 10*a* and 14*a* to be tensioned between the air injection block 74 and the drawing and slackening unit 20 and accordingly between the first and second drawing and slackening units 18 and 20 when moved across the path of the leading and trailing end portions 10*a* and 14*a* of the yarns 10 and 14.

Description will now be made with concurrent reference to FIGS. 1 to 3 regarding the operation of the yarn-end joining apparatus constructed and arranged as hereinbefore described.

When the apparatus is maintained at rest, the piston 40 of each of the power cylinders 32 and 36 of the first and second drawing and slackening units 18 and 20 is maintained in an axial position close to the end wall 44 of the cylinder body by the force of the compression spring 50 and in the absence of fluid pressure in the fluid chamber 42. The movable clamp element 62 carried by the piston rod 54 is thus spaced apart from the stationary clamp element 28 on the clamp holder 22 of the first drawing and slackening unit 18 and, likewise, the movable clamp element 72 carried by the piston rod 64 is spaced apart from the stationary clamp element 30 on the clamp holder 24 of the second drawing and slackening unit 20. Furthermore, the rockable clamp holder 24 of the second drawing and slackening unit 20 is maintained in the previously mentioned first angular position thereof position extending in parallel with the stationary clamp holder 22 of the first drawing and slackening unit 18, viz., at right angles to the predetermined path along which the leading and trailing end portions 10*a* and 14*a* of the yarns 10 and 14 are to extend between the first and second drawing and slackening units 18 and 20 as shown in FIG. 1. The valve intervening between the air injection passageway 78 of the air injection block 74 and the air compressor is closed so that there is no stream of air through the passageway 78 and, furthermore, the tension adjusting member 82 is withdrawn from the predetermined path along which the leading and trailing end portions 10*a* and 14*a* of the yarns 10 and 14 are to extend between the first and second drawing and slackening units 18 and 20.

Before the yarn-end joining apparatus is actuated into operation, the leading end portion 10*a* of the first multi-filament yarn 10 wound on the supply bobbin 12 is unwound from the yarn package and is passed forwardly through the space between the clamp elements 30 and 72 of the second clamping and drawing unit 20, then through the yarn passageway 76 in the air injection block 74 and further through the space between the clamp elements 28 and 62 of the first clamping and drawing unit 18. Likewise, the trailing end portion 14*a* of the second multi-filament yarn 14 wound on the take-up bobbin 16 is unwound from the yarn package and is passed backwardly through the space between the clamp elements 28 and 62 of the first drawing and slackening unit 18, then through the yarn passageway 76 in the air injection block 74 and further through the space between the clamp elements 30 and 72 of the second drawing and slackening unit 20. The respective leading and trailing end portions 10*a* and 14*a* of the first and second multi-filament yarns 10 and 14 thus extending between the supply and take-up bobbins 12 and 16 are longitudinally held in contact with each other on and between the first and second drawing and slackening units 18 and 20 with lengths larger than the distance between the drawing and slackening units 18 and 20.

The power cylinders 32 and 36 of the first and second drawing and slackening units 18 and 20 are then actuated to direct fluid under pressure into the respective fluid chambers 42 of the cylinders 32 and 36. The fluid pressure thus developed in the fluid chamber 42 of each of the power cylinders 32 and 36 acts on the piston 40 and forces the piston 40 to axially move in the direction to expand the fluid chamber 42 against the opposing force of the spring 50. The piston rods 54 and 64 of the power cylinders 32 and 36 are therefore caused to axially move toward the stationary clamp elements 28 and 30, respectively, of the first and second clamping and drawing units 18 and 20 so that the movable clamp elements 62 and 72 carried by the piston rods 54 and 64 of the power cylinders 32 and 36 are brought into pressing contact with the stationary clamp elements 28 and 30, respectively. The drive means for the second drawing and slackening unit 20 is then actuated to drive the rockable clamp holder 24 of the clamping and drawing unit 20 to turn in the direction of the arrow A about the center axis of the pivot pin 26 so that the clamp holder 24 of the drawing and slackening unit 20 is turned from the first angular position to the second angular position spaced wider apart from the clamp holder 22 of the first drawing and slackening unit 18. The drawing and slackening unit 20 being thus spaced wider apart from the first clamping and drawing unit 18, the leading and trailing end portions 10*a* and 14*a* of the multi-filament yarns 10 and 14 intervening between the first and second drawing and slackening units 18 and 20 are forced to stretch and are accordingly drawn and elongated between the drawing and slackening units 18 and 20. In this instance, it is preferable that the rockable clamp holder 24 of the drawing and slackening unit 20 be driven to turn from the first angular position to the second angular position through such an angle that will cause the leading and trailing end portions 10*a* and 14*a* of the yarns 10 and 14 to be drawn and elongated between the drawing and slackening units 18 and 20 with an elongation percentage of from about 0.8 to about 1.2 times the proper elongation percentage of each of the yarns 10 and 14. When the leading and trailing end portions 10*a* and 14*a* of the yarns 10 and 14 are thus forced to stretch between the first and second drawing and slackening units 18 and 20, the leading and trailing end portions 10*a* and 14*a* are urged to slide between the clamp elements 28 and 62 of the first drawing and slackening unit 18 and the clamp elements 30 and 72 of the second drawing and slackening unit 20. Since the clamp elements 28, 30, 62 and 72 are constructed of, for example, polyurethane rubber as previously mentioned, the end portions 10*a* and 14*a* are precluded from being dislodged from the clamp elements 28/62 and 30/72, respectively.

The drive means associated with the rockable clamp holder 24 of the second drawing and slackening unit 20 is then actuated for a second time for driving the rockable clamp holder 24 of the second drawing and slackening unit 20 to turn backwardly from the second angular position to the first angular position thereof, thereby allowing the leading and trailing end portions 10*a* and 14*a* of the yarns 10 and 14 to be slackened between the first and second drawing and slackening units 18 and 20. The tension adjusting merber 82 may thereafter be driven to move across the path of the leading and trailing end portions 10*a* and 14*a* of the yarns 10 and 14 between the drawing and slackening units 18 and 20 so that the leading and trailing end portions 10*a* and 14*a* of the yarns 10 and 14 are laterally engaged by the adjusting member and appropriately tensioned between the air injection block 74 and the clamping and drawing unit 20 and accordingly between the first and second drawing and slackening units 18 and 20 depending upon the distance of movement of the adjusting member 82.

The air compressor associated with the air injection block 74 is now actuated to direct compressed air into the air injection passageway 78 in the block 74. The compressed air thus directed into the air injection passageway 78 is injected into the yarn passageway 76 in the block 74 and perpendicular-ly impinges upon the leading and trailing end portions 10*a* and 14*a* of the yarns 10 and 14 extending in the yarn passageway 76. The end portions 10*a* and 14*a* of the yarns 10 and 14 subjected to the jet stream of air in the yarn passageway 76 are caused to disintegrate into individual filaments and to entwine on and around one another. The leading and trailing end portions 10*a* and 14*a* of the first and second multi-filament yarns 10 and 14 are in this manner spliced together through the individual filaments thus entwined on one another. If, in this instance, the leading and trailing end portions 10*a* and 14*a* of the yarns 10 and 14 are slackened or insufficiently properly tensioned between the drawing and slackening units 18 and 20, the filaments thus entwined would form loops. Adjusting the tension in the end portions 10*a* and 14*a* of the yarns 10 and 14 by means of the tension adjusting member 82 is for this reason important. After the multi-filament yarns 10 and 14 are conjoined together end to end in the yarn passageway 76, the supply of compressed air to the air injection block 74 is terminated and at the same time the fluid under pressure is discharged from each of the power cylinders 32 and 36 of the first and second drawing and slackening units 18 and 20. The piston 40 of each of the power cylinders 32 and 36 is now caused to move backwardly toward the end wall 44 by the force of the spring 50, causing the movable clamp elements 62 and 72 to move away from the stationary clamp elements 28 and 30 of the first and second drawing and slackening units 18 and 20, respectively. The continuous single yarn having the spliced portion formed by the interwoven filaments can now be wound on the take-up bobbin 16.

When the length L of the yarn passageway 76 in the air injection block 74 is selected within the range of between about 4 mm and about 12 mm as previously mentioned, the filaments into which the leading and trailing end portions 10*a* and 14*a* of the yarns 10 and 14 are integrated as above described are caused to entwine on one another over a length of from about 5 mm to about 15 mm. If the length L of the yarn passageway 76 is less than 4 mm and as a consequence the filaments of the yarns 10 and 14 are caused to entwine on one another over a length less than 5 mm, the breaking strength of the conjoined Portions of the yarns 10 and 14 becomes less than 62 percent of the breaking strength of each of the yarns 10 and 14. When the yarn having such a spliced portion is subjected to false twist, the filaments forming the spliced portion would be caused to untwine from one another. If, conversely, the length L of the yarn passageway 76 exceeds 12 mm and as a consequence the filaments of the yarns 10 and 14 are caused to entwine on one another over a length greater than 15 mm, then the resultant yarn would be caused to break or fail to untwine during the subsequent high-speed friction, partially-orienting, draw-texturing process. When the length of the yarn passageway 76 in the air injection block 74 is selected to be within the range of between about 4 mm and about 12 mm, the yarns 12 and 14 are spliced together over a length of from about 5 mm to about 15 mm and thus the problems as above discussed will not be encountered.

Because, furthermore, of the fact that the leading and trailing end portions 10*a* and 14*a* of the yarns 10 and 14 are drawn and elongated before they are tied together as above described, the end portion of each yarn is rendered thinner between the drawing and slackening units 18 and 20. If the angle between the first and second angular positions of the rockable clamp holder 24 of the second drawing and slackening unit 20 with respect to the first drawing and slackening unit 18 is selected properly, the end portion of each of the yarns 10 and 14 can be thinned to the square root of less than 2 in diameter of the original thickness. This is also conducive to preventing the resultant yarn from being caused to brake or failing to untwine during the subsequent high-speed friction, partially-orienting, draw-texturing process.

What is claimed is:

1. A method of joining together respective leading and trailing end portions of two multi-filament yarns, comprising the steps of disposing the leading and trailing end portions of the two multi-filament yarns in longitudinally contacting conditions, clamping the end portions of the multi-filament yarns at two points which are located at a predetermined distance from each other, drawing and slackening the end portions of the yarns between said two points, and blowing air under pressure toward the end portions of the yarns so that a jet stream of air impinges at a predetermined angle upon the end portions of the yarns over a predetermined length of the end portions between said two points for causing the end portions of the yarns to disintegrate into filaments over said predetermined length and causing the filaments to entwine on one another.

2. A method as set forth in claim 1, in which said predetermined length over which said air under pressure impinges upon the end portions of the yarns between said points is within the range of between about 4 mm and about 12 mm.

3. A method as set forth in claim 1, in which said end portions of the yarns are drawn between said two points with an elongation percentage of from about 0.8 to about 1.2 times the proper elongation percentage of each of the yarns.

4. A method as set forth in claim 1, in which said end portions of the yarns are drawn between said two points to such an extent that each of the end portions is thinned to the square root of less than 2 in diameter of the original thickness of the yarn.

5. A method as set forth in claim 1, in which said predetermined length over which said air under pressure impinges upon the end portions of the yarns between said points is within the range of between about 4 mm and about 12 mm and in which said end portions of the yarns are drawn between said two points with an elongation percentage of from about 0.8 to about 1.2 times the proper elongation percentage of each of the yarns.

6. A method as set forth in claim 1, in which said end portions of the yarns are drawn between said two points with an elongation percentage of from about 0.8 to about 1.2 times the proper elongation percentage of each of the yarns and in which the end portions of the yarns are caused to entwine on one another over a length of from about 5 mm to about 15 mm.

7. A method as set forth in any one of claims 1, further comprising the step of adjusting the tension in the end portions of the yarns between said two points.

8. A method as set forth in any one of claims 1, in which air under pressure is blown toward the end portions of the yarns so that a jet stream of air impinges upon the end portions of the yarns substantially at right angles to the end portions.

9. A yarn-end joining apparatus for joining together respective leading and trailing end portions of two multi-filament yarns, comprising first and second clamp means operable for clamping the end portions of the multi-filament yarns at two points which are located at a predetermined distance from each other, first and second yarn drawing and slackening means operable for drawing and slackening, between said first and second clamp means, the end portions of the yarns having the end portions clamped by said first and second clamp means, at least one of the first and second yarn drawing means being movable toward and away from the other yarn drawing means, and air blowing means positioned between said first and second clamp means and operable for blowing air under pressure toward the end portions of the yarns so that a jet stream of air impinges at a predetermined angle upon the end portions of the yarns over a predetermined length of the end portions between said first and second clamp means for causing the end portions of the yarns to disintegrate into filaments over said predetermined length and causing the filaments to entwine on one another.

10. A yarn-end joining apparatus as set forth in claim 9, further comprising tension adjusting means for adjusting the tension in the leading and trailing end portions of the yarns between said first and second clamp means.

11. A yarn-end joining apparatus as set forth in claim 9, in which said first and second clamp means are supported on said first and second yarn drawing and slackening means, respectively.

12. A yarn-end joining apparatus as set forth in claim 11, in which one of said yarn drawing and slackening means is angularly movable with respect to the other yarn drawing and slackening means between a first angular position spaced apart a predetermined angle from the other yarn drawing and slackening means and a second angular position spaced wider apart from the other yarn drawing means.

13. A yarn-end joining apparatus as set forth in claim 9, in which each of said first and second clamp means comprises a stationary clamp element fixedly positioned on the drawing and slackening means and a movable clamp element which is movable into and out of contact with the stationary contact element.

14. A yarn-end joining apparatus as set forth in claim 13, in which each of said clamp elements is constructed of an elastic material.

15. A yarn-end joining apparatus as set forth in claim 14, in which said elastic material is polyurethane rubber.

16. A yarn-end joining apparatus as set forth in claim 13, in which each of said clamp elements is constructed of metal having a mirror finished contact surface.

17. A yarn-end joining apparatus as set forth in claim 9, in which said air blowing means comprises an air injection block formed with a straight yarn passageway having open inlet and outlet ends and adapted to pass said leading and trailing end portions of the yarns therethrough between said first and second clamp means and an air injection passageway which is open at one end thereof to said yarn passageway and which is communicable at the other end thereof to a source of air under pressure.

18. A yarn-end joining apparatus as set forth in claim 17, in which said air injection passageway is open substantially perpendicularly to said yarn passageway.

19. A yarn-end joining apparatus as set forth in claim 17, in which the length of said yarn passageway is within the range of 4 mm and 12 mm.

* * * * *

UNITED STATES PATENT AND TRADEMARK OFFICE

CERTIFICATE OF CORRECTION

PATENT NO. : 4,468,919

DATED : September 4, 1984

INVENTOR(S) : Jiro NAKAJO and Shunzo NAITO

It is certified that error appears in the above-identified patent and that said Letters Patent is hereby corrected as shown below:

On the Title Page in the heading

Add to Item [30] the following omitted Foreign Application Priority Data:

-- August 27, 1982 Japan.....57-149768 --

Signed and Sealed this

*Twenty-eighth* Day of *May 1985*

[SEAL]

*Attest:*

DONALD J. QUIGG

*Attesting Officer* *Acting Commissioner of Patents and Trademarks*